US008308034B2

(12) United States Patent
Shibata et al.

(10) Patent No.: US 8,308,034 B2
(45) Date of Patent: Nov. 13, 2012

(54) HOOK STRUCTURE OF POWER TOOL

(75) Inventors: Yoshinori Shibata, Anjo (JP); Tomohiro Ukai, Anjo (JP)

(73) Assignee: Makita Corporation, Aichi (JP)

( * ) Notice: Subject to any disclaimer, the term of this patent is extended or adjusted under 35 U.S.C. 154(b) by 977 days.

(21) Appl. No.: 12/216,766

(22) Filed: Jul. 10, 2008

(65) Prior Publication Data

US 2009/0025515 A1 Jan. 29, 2009

(30) Foreign Application Priority Data

Jul. 26, 2007 (JP) ..... 2007-194956
Feb. 7, 2008 (JP) ..... 2008-027947

(51) Int. Cl.
*B25B 29/00* (2006.01)

(52) U.S. Cl. ..... 224/269; 224/255; 224/268; 224/904

(58) Field of Classification Search ..... 224/255, 224/260, 268, 269, 904; 24/370, 374, 375, 24/376, 547; 248/211, 690, 691, 692; 81/185.2, 81/57.4; 215/399; 220/761
See application file for complete search history.

(56) References Cited

U.S. PATENT DOCUMENTS 1,273,201 A * 7/1918 Teuber ..... 224/182
2,304,547 A * 12/1942 Cutter ..... 248/692
2,447,862 A * 8/1948 Kane ..... 248/685
2,694,844 A * 11/1954 Grumbach ..... 24/374
3,286,315 A * 11/1966 Price ..... 24/374
5,044,038 A * 9/1991 Matkovic ..... 15/159.1
5,265,312 A * 11/1993 Okumura ..... 24/3.12
6,321,622 B1 * 11/2001 Tsuge et al. ..... 81/57.4
6,609,693 B2 * 8/2003 Hui ..... 248/489
6,766,997 B2 * 7/2004 Stewart, III ..... 248/690
7,111,364 B2 * 9/2006 Bader et al. ..... 16/436
7,306,052 B2 * 12/2007 Vahabi-Nejad et al. ..... 173/217
2006/0104735 A1 * 5/2006 Zeiler et al. ..... 408/241 R

FOREIGN PATENT DOCUMENTS

DE 199 46 455 A1 4/2000
DE 10 2004 032 788 A1 2/2006
JP A-10-094975 4/1998
JP B2-3676609 5/2005

OTHER PUBLICATIONS

European Search Report issued in corresponding European Patent Application No. 08011418.4, mailed Mar. 17, 2010.

* cited by examiner

*Primary Examiner* — Nathan J Newhouse
*Assistant Examiner* — Steven M Landolfi, Jr.
(74) *Attorney, Agent, or Firm* — Oliff & Berridge, PLC

(57) ABSTRACT

In a housing of a power tool is formed a hook-receiving portion, with openings facing leftward and rightward, through which a substantially U-shaped hook having a left hook leg and a right hook leg is movable among a left protruding position in which the left hook leg protrudes leftward from the hook-receiving portion, a right protruding position in which the right hook leg protrudes rightward from the hook-receiving portion, and an accommodating position in which the left and right hook legs are both accommodated in the hook-receiving portion. Also provided in the housing is a retaining mechanism by which the hook is retainable in one of the positions of the left protruding position, right protruding position, and accommodating position.

17 Claims, 11 Drawing Sheets

HOOK STRUCTURE OF POWER TOOL

BACKGROUND OF THE INVENTION

This application claims the entire benefit of Japanese Patent Application Numbers 2007-194956 filed on Jul. 26, 2007 and 2008-27947 filed on Feb. 7, 2008, the entirety of which is incorporated by reference.

FIELD OF THE INVENTION

This invention relates to a hook structure of a power tool for making the power tool suspensible.

DESCRIPTION OF RELATED ART

It is not uncommon to find a power tool having a hook or a hook-shaped structure with which the power tool can be suspended on an engageable portion provided on a wall, a belt of an operator, or the like. The hook may be a nuisance during performance of work due to its protrusion unless it is retractable. For this reason, the power tool may have a housing provided with a hook-receiving portion into which the hook can be retracted when the hook is not in use, as described for example in Japanese Patent No. 3676609 (JP 3676609 B2).

Meanwhile, the power tool suspensible on the belt of an operator is preferably designed to allow the operator to wear it on his/her waist either at the left side or at the right side arbitrarily at his/her convenience in use. In this respect, Japanese Laid-Open Patent Application, Publication No. 10-94975 (JP 10-94975 A) discloses a hook device in which a hook arm having hooks provided at its left and right ends and a laterally oblong slot at its center is provided, and a rectangular cross section shaft mounted on a grip is fitted in the oblong slot in a manner that permits the hook arm to slide and to be fixed at either end of its sliding range.

As described above, the features which render the hook retractable when not in use and protrusible at either side when in use would be both desirable for improvement in usability or convenience of the power tool. However, the structure of JP 3676609 B is designed on the premise that the hook is used in a single location (i.e., unretracted and protruding position) from which it is retractable into the hook-receiving portion. Thus, it allows the hook to be protruded and retracted only at a single side of the power tool. Therefore, according to the structure as disclosed, it is essentially difficult to receive and house the hook in this hook-receiving portion from two protruding positions at both sides. On the other hand, the structure of JP 10-94975 A proposes a simple structure in which the hook arm is slidably supported by the rectangular cross section shaft; thus even though a hook-receiving portion could conceivably be provided in the grip to receive and house the hook therein from one of the two sides of the power tool, it is also difficult to receive and house the hooks in this hook-receiving portion from two protruding positions at both sides. Even if the hook arm could be fixed in a middle position, the both ends of the hook arm cannot be fully retracted because the length of the hook arm in its sliding direction is long enough to render the hook at both ends protrusible. Thus it could resultantly disturb the operator during performance of work.

The present invention has been made in an attempt to eliminate the above disadvantages, and illustrative, non-limiting embodiments of the present invention overcome the above disadvantages and other disadvantages not described above.

SUMMARY OF THE INVENTION

It is an aspect of the present invention to provide a hook structure of a power tool in which a hook rendered retractable when not in use and protrusible at either side of the power tool when in use is realized with a simple configuration.

More specifically, in one aspect of the present invention, there is provided a hook structure of a power tool comprising a hook-receiving portion, a substantially U-shaped hook, and a retaining mechanism. The hook-receiving portion is provided in a housing of the power tool, with openings facing leftward and rightward. The hook has two legs and the hook-receiving portion of the housing is capable of accommodating the hook. The hook is movable among a left protruding position in which the left hook leg protrudes leftward from the hook-receiving portion, a right protruding position in which the right hook leg protrudes rightward from the hook-receiving portion, and an accommodating position in which the left and right hook legs are both accommodated in the hook-receiving portion. By the retaining mechanism, the hook is retainable in one of the positions of the left protruding position, right protruding position, and accommodating position.

According to the above aspect, a hook can be rendered retractable when not in use and protrusible at either side of the power tool when in use with a simple configuration, and thus the usability or convenience of the power tool can be improved. Particularly, since the hook legs of the hook in the accommodating position do not protrude either leftward or rightward, the hook legs fully retracted when not in use would never disturb an operator during performance of work, so that the power tool can be handled with increased ease.

The aforementioned retaining mechanism, in one exemplary embodiment, may comprise a lock member and a biasing device. In this embodiment, the lock member comprises an engageable part that is engageable with the hook in one of the positions of the left protruding position, right protruding position, and the accommodating position. Furthermore, the lock member is movable between an upper engaging position in which the engageable part protrudes into the hook-receiving portion so as to engage with the hook and a lower disengaging position in which the engageable part retracts out of the hook-receiving portion so as to disengage from the hook. The biasing device in this embodiment is configured to bias the lock member toward the upper engaging position. The lock member may be configured to be manipulatable from outside the hook-receiving portion so as to be pressed down into the lower disengaging position.

According to the above embodiment, additional advantages can be expected in that the lock member can be manipulated in simple pressing-down and releasing operations to thereby hold the hook in any one of the positions of the left protruding position, the right protruding position, and the accommodating position. That is, a simplified hook structure of the power tool and an improved operability in alteration of the position of the hook can be achieved.

In another exemplary embodiment, the above hook structure, with or without the above additional features, may further comprise a second retaining mechanism, wherein the hook-receiving portion is provided with an opening facing upward, through which the hook is swingable so as to allow one of the left and right hook legs to move to an upward protruding position in which one of the left and right hook legs protrudes upward from the hook-receiving portion, and the second retaining mechanism is configured to retain the hook in the upward protruding position.

According to this embodiment, additional advantages can be expected in that the hook can also be utilized as an upwardly protruding hook. That is, the variety of modes of using the hook can be increased and the usability can be improved accordingly.

In still another exemplary embodiment, the above second retaining mechanism may comprise a second biasing device and a holding recess. In this embodiment, the second biasing device is configured to bias the hook toward a forward or backward direction, and the holding recess is provided continuously with the upward opening to allow the hook in the upward protruding position to move in the forward or backward direction by the action of the biasing device so that the hook moved in the holding recess is held in the upward protruding position.

With these additional features, advantageously, besides the aforementioned advantageous effects, the second retaining mechanism in which the holding operation of the hook in the upward protruding position can be easier and more effectively is obtained.

Alternatively, the retaining mechanism in still another exemplary embodiment may comprise a sliding member, a biasing device, and a plurality of engageable portions. In this embodiment, the sliding member is slidable between an engaging position in which the hook is retained in one of the positions of the left protruding position, the right protruding position, and the accommodating position and a disengaging position in which the hook is released; the biasing device is configured to bias the sliding member toward the engaging position; and the plurality of engageable portions are provided on the hook and configured such that the sliding member in the engaging position is engageable with one of the plurality of engageable portions to thereby hold the hook in the corresponding one of the left protruding, right protruding, and accommodating positions. Furthermore, the sliding member is configured to be manipulatable from outside the hook-receiving portion so as to be slid into the disengaging position.

According to this embodiment, additional advantages can be expected in that the hook can be retained in each position through a sliding operation of the sliding member. That is, an improved operability in alteration of the position of the hook can be achieved. Furthermore, as contrasted with the embodiment in which the lock member is pressed down, the amount of protrusion of the sliding member from the power tool can be reduced.

BRIEF DESCRIPTION OF THE DRAWINGS

The above aspects, other advantages and further features of the present invention will become more apparent by describing in detail illustrative, non-limiting embodiments thereof with reference to the accompanying drawings, in which:

FIGS. 2A and 2B show a state of the hook structure in which a hook is located in a left protruding position, FIGS. 2C and 2D show a state of the hook structure in which the hook is slid halfway, and FIGS. 2E and 2F show a state of the hook structure in which the hook is located in an accommodating position;

FIGS. 5A and 5B show a state of the hook structure in which a hook is located in a right protruding position, FIGS. 5C and 5D show a state of the hook structure in which the hook is located in an upward protruding position, and FIG. 5E shows a longitudinal section of the hook structure of FIG. 5C;

DETAILED DESCRIPTION OF THE EXEMPLARY EMBODIMENTS

Exemplary embodiments of the present invention will be described hereinafter with reference to the accompanying drawings.

First Embodiment

Figure 1A:
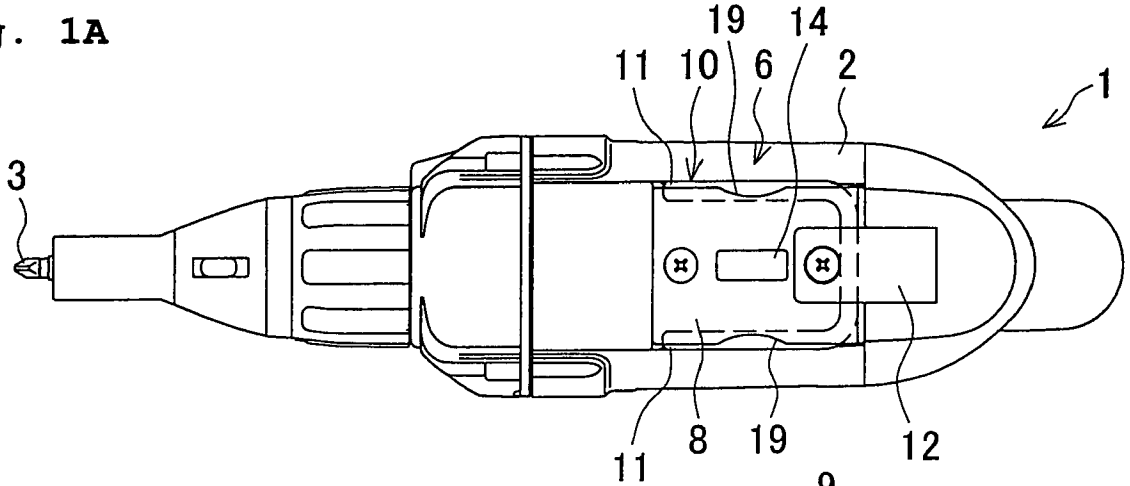
FIGS. 1A and 1B illustrate a general external appearance of a power screwdriver, of which a plan view is shown in FIG. 1A and a side elevation is shown in FIG. 1B.
Figure 1B:
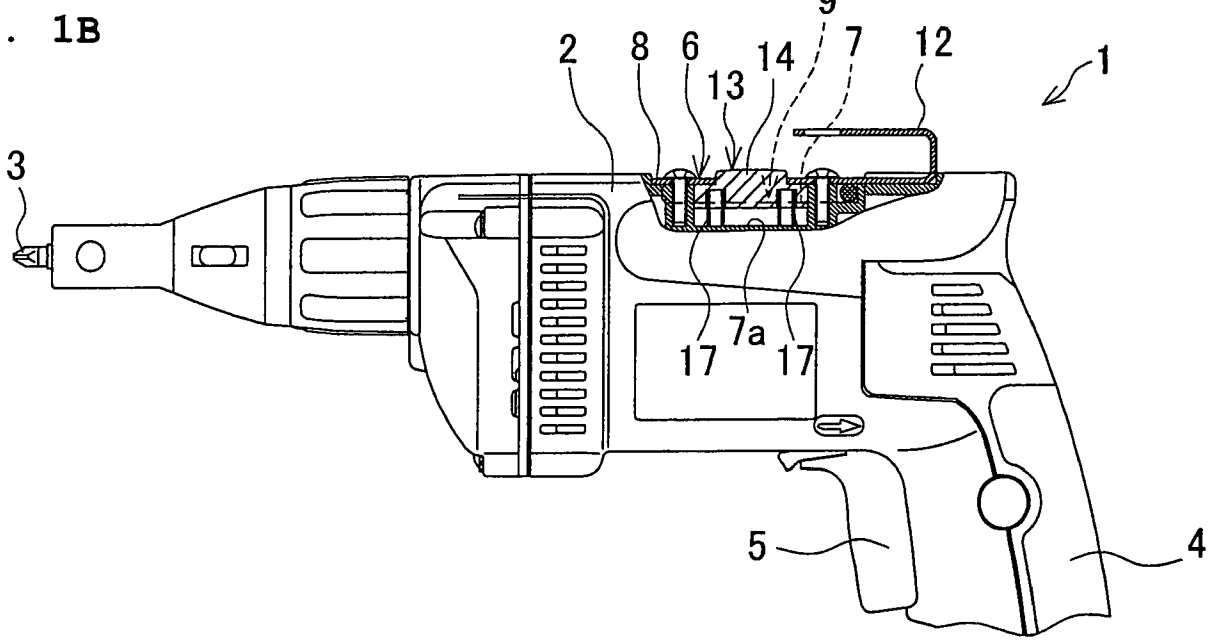

A power screwdriver 1 shown in FIGS. 1A and 1B is one example of a power tool with a hook structure consistent with the present invention. The power screwdriver 1 is of a type known in the art, and has electric power elements (not shown), such as a motor, a rotation transmission mechanism and a torque limiter, incorporated in a housing 2, to produce and transmit the torque to a screwdriver bit 3 held at a front end (left-hand end in FIGS. 1A and 1B) of the power screwdriver 1. At the rear of the housing 2 of the power screwdriver 1, a grip 4 extending therefrom and having a trigger switch 5 is provided.

At an upper surface of the housing 2, a hook unit 6 is provided as a hook structure according to a first embodiment of the present invention. The hook unit 6 includes a hook-receiving portion 9 provided in the housing 2 with openings facing leftward and rightward, and a substantially U-shaped hook 10 having two legs 11 which are a left hook leg 11 and a right hook leg 11. The hook-receiving portion 9 is provided between a bottom surface of a recess 7 formed in the housing 2 and an upper plate 8 screwed at a position spaced a predetermined distance out from the recess 7. The hook 10 has a lateral dimension (width between outer sides of the hook legs 11) such that the hook-receiving portion 9 can substantially fully accommodate the hook 10. Thus, the hook 10 with the ends of the hook legs 11 oriented toward the front of the power screwdriver 1 can be slid widthwise into and received in the hook-receiving portion 9. At a rear end of the upper plate 8, an upper hook 12 shaped like an inversed L is provided with its end oriented toward the front of the power screwdriver 1.

Figure 2A:
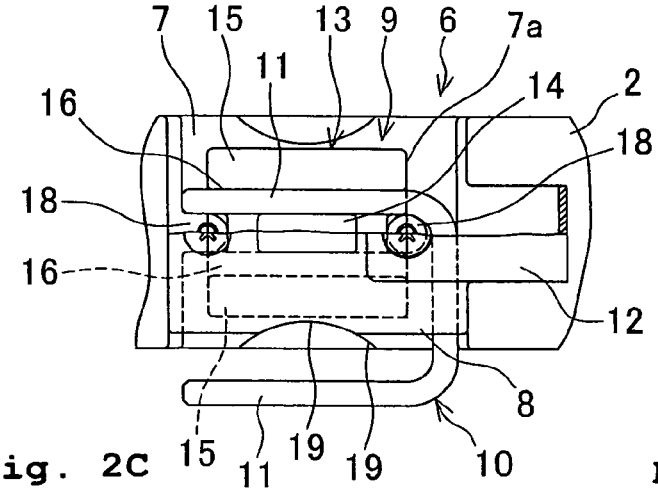
FIGS. 2A to 2F are explanatory diagrams of a hook structure of a power screwdriver according to a first embodiment, where
Figure 2B:
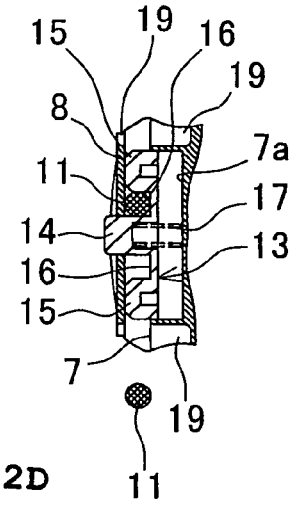
Figure 3A:
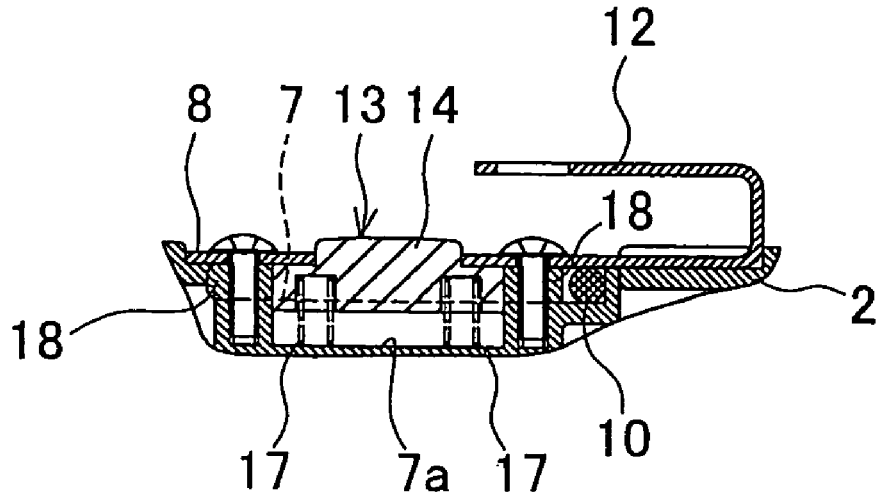
FIGS. 3A and 3B are sectional views of the hook structure, taken along lines A-A and B-B of FIG. 2E, respectively.
Figure 3B:
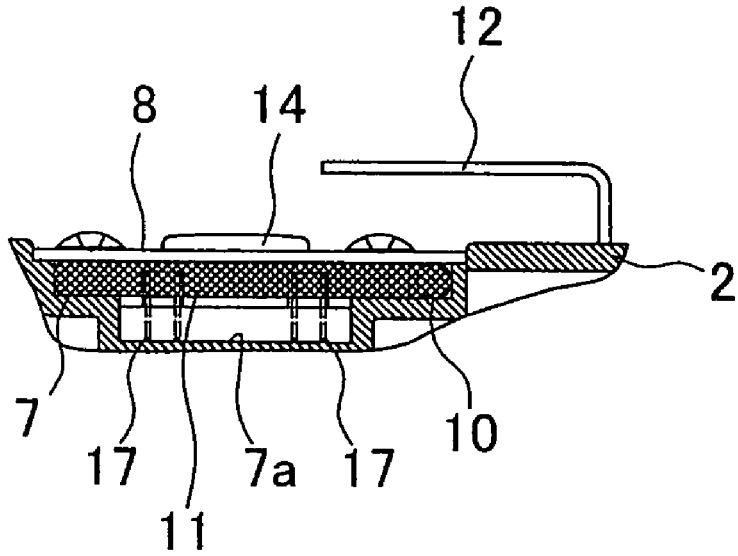

Denoted by 13 is a lock button provided to fit in an engageable part-receiving recess 7*a* which is a portion recessed deeper at a center of the bottom surface of the recess 7. The lock button 13 in this exemplary embodiment works as a 'retaining mechanism' or a 'lock member' defined in the present invention. Referring now to FIGS. 2A and 2B, the lock button 13 includes an operation part 14 and two locking elements 15. The operation part 14 is shaped like a rectangular parallelepiped and protrudes upward through a center of the upper plate 8. The locking elements 15 each shaped like a rectangular parallelepiped are disposed apart from the operation part 14 leftward and rightward with clearances given between the operation part 14 and the respective locking elements 15 so as to form grooves 16 such that one of the left and right hook legs 11 can fit in one of the grooves 16. The left and right locking elements 15 protrude toward inward of the hook-receiving portion 9, upward to a level lower than that of the operation part 14. The locking elements 15 in this exemplary embodiment works as an 'engageable part' in the present invention. A pair of coil springs 17 is provided between the lock button 13 and the bottom surface of the engageable part-receiving recess 7*a*. The lock button 13 is biased by the coil spring 17 and positioned in normal times in an upper-limit position (upper engaging position) where upper surfaces of the locking elements 15 are in contact with the upper plate 8, as seen in FIG. 3A as well. When the lock button 13 is pressed down against the biasing force of the coil spring 17 by means of the operation part 14, the lock button 13 can be lowered down to a lower-limit position (lower disengaging position) where the upper surfaces of the locking elements 15 are substantially flush with the bottom surface of the recess 7.

In the recess 7, two bosses 18 protruding upward from the bottom surface of the engageable part-receiving recess 7*a*, for use in screwing the upper plate 8 down, are provided at the front and back sides of the operation part 14. When the hook 10 is accommodated in the hook-receiving portion 9, the operation part 14 and the bosses 18 are disposed between the left and right hook legs 11, so that the hook 10 can be prevented from falling out even when the lock button 13 is depressed to the lower-limit position. The distance between outer sides of the locking elements 15 (between the left side of the left locking element 15 and the right side of the right locking element 15) are set in accordance with the distance between inner sides of the left and right hook legs 11, so that the left and right locking elements 15 can fit in a space between the hook legs 11.

Figure 2C:
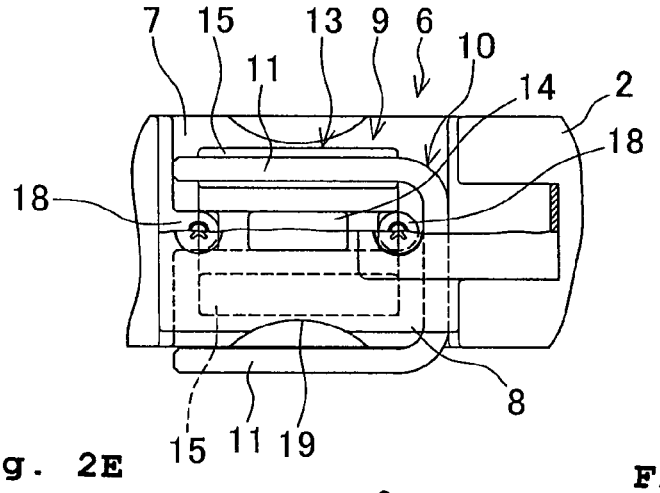
Figure 2D:
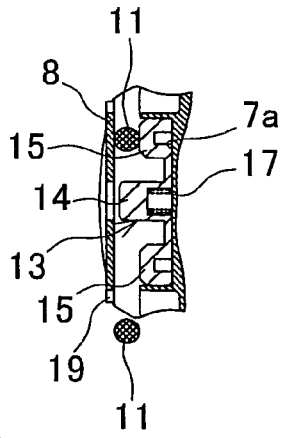
Figure 2E:
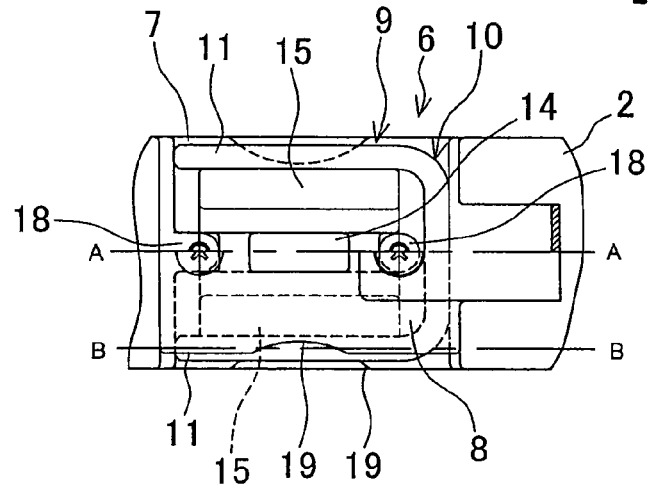
Figure 2F:
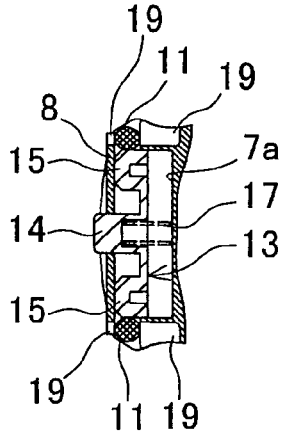

According to the hook structure of the power screwdriver 1 configured as described above, when the lock button 13 is depressed to the lower-limit position as shown in FIGS. 2C and 2D, the hook 10 becomes slidable either leftward or rightward through the hook-receiving portion 9 within the limits defined by the operation part 14 and the bosses 18. Accordingly, when the right hook leg 11 of the hook 10 is positioned, for example, over the right groove 16 formed between the right locking element 15 and the operation part 14, and the pressure on the lock button 13 is released, the lock button 13 returns to the upper-limit position, so that the left hook leg 11 is fitted into the right groove 16. Consequently, the hook 10 is retained in the left protruding position in which the left hook leg 11 protrudes leftward from the hook-receiving portion 9 as shown in FIGS. 2A and 2B, so that the power screwdriver 1 becomes suspensible on the waist belt of an operator at his/her right side or somewhere like that. Similarly, when the left hook leg 11 of the hook 10 is fitted into the left groove 16, the hook 10 is retained in the right protruding position in which the right hook leg 11 protrudes rightward from the hook-receiving portion 9, so that the power screwdriver 1 becomes suspensible on the waist belt of an operator at his/her left side or somewhere like that.

With the lock button 13 depressed to the lower-limit position, when the hook 10 is slid to the center until the left and right hook legs 11 come to the positions outside the left and right locking elements 15 respectively, and then the pressure on the lock button 13 is released, the hook 10 is retracted and accommodated in the hook-receiving portion 9 as shown in FIGS. 2E, 2F, 3A and 3B, and held by the locking elements 15 in the accommodating position in which the left and right hook legs 11 both are fully accommodated without protruding. It is understood that when the hook 10 is to be slid from the accommodating position to the left or right protruding position, the lock button 13 may be depressed to the lower-limit position for subsequent operation conducted in the same way as described above. At left and right sides of the recess 7 and the upper plate 8, indentations 19 are formed to facilitate the manual operation of sliding the hook 10 either leftward or rightward.

As described above, in the hook unit 6 (as a hook structure according to the first embodiment), a hook-receiving portion 9 with openings facing leftward and rightward is provided in the housing 2, and the substantially U-shaped hook 10 having the left and right hook legs 11 is provided in such a manner that the hook 10 is movable among the left protruding position in which the left hook leg 11 protrudes leftward from the hook-receiving portion 9, the right protruding position in which the right hook leg 11 protrudes rightward from the hook-receiving portion 9, and the accommodating position in which the left and right hook legs 11 are both accommodated in the hook-receiving portion 9. Moreover, this hook structure includes a retaining mechanism (i.e., lock button 13) by which the hook 10 is retainable in one of the positions of the left protruding position, the right protruding position, and the accommodating position. The first embodiment of the hook structure can thus render the hook 10 retractable when not in use and protrusible at either side of the power screwdriver 1 when in use with a simple configuration, with the result that the usability or convenience of the power screwdriver 1 can be improved. In particular, since the hook legs 11 of the hook 10 in the accommodating position do not protrude either leftward or rightward, the hook legs 11 fully retracted when not in use would never cause a nuisance during execution of work, so that the power screwdriver 1 can be manipulated with increased ease.

Furthermore, the retaining mechanism is embodied by the lock button 13 in combination with the coil springs 17, wherein the lock button 13 includes the left and right locking elements 15 engageable with the hook 10 in any one of the positions of the left protruding position, the right protruding position and the accommodating position, and is movable between the upper engaging position in which the locking elements 15 protrudes into the hook-receiving portion 9 so as to engage with the hook 10 and a lower disengaging position in which the locking elements 15 retracts out of the hook-receiving portion 9 so as to disengage from the hook 10. The lock button 13 is biased toward the upper engaging position by the coil springs 17, and configured to be manipulatable from outside the hook-receiving portion 9 so that it can be pressed down into the lower disengaging position. Accordingly, by the simple pressing-down and releasing operations on the lock button 13, the hook 10 can be held in any one of the left protruding, right protruding, and accommodating positions. As a result, a simplified and easy-to-use hook structure of the power screwdriver 1 and an improved operability in alteration of the position of the hook 10 can be realized.

Second Embodiment

Figure 4A:
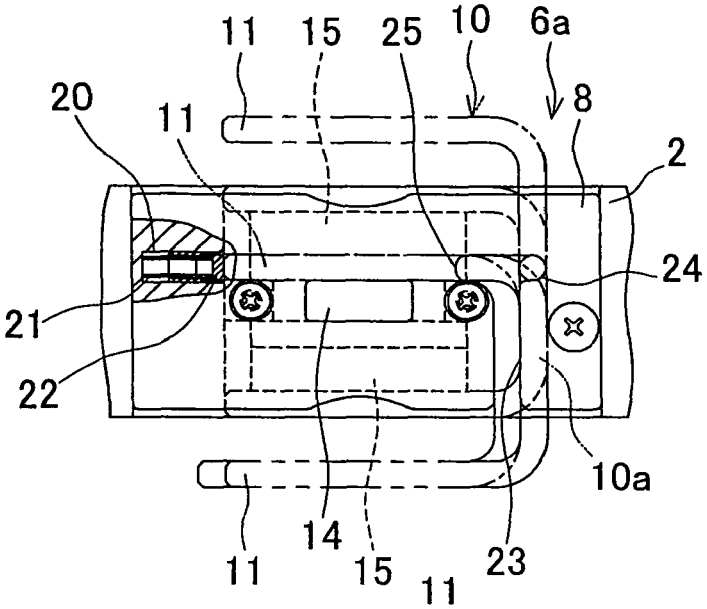
FIGS. 4A, 4B and 4C explicatively illustrate a hook structure according to a second embodiment, where a plan view thereof is shown in FIG. 4A, a cross sectional view thereof is shown in FIG. 4B, and a longitudinal sectional view thereof is shown in FIG. 4C.
Figure 4B:
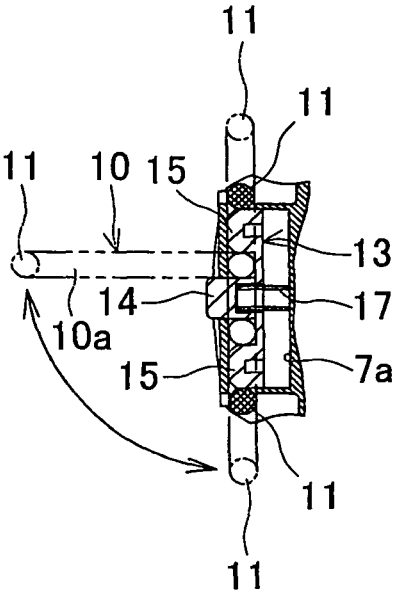
Figure 4C:
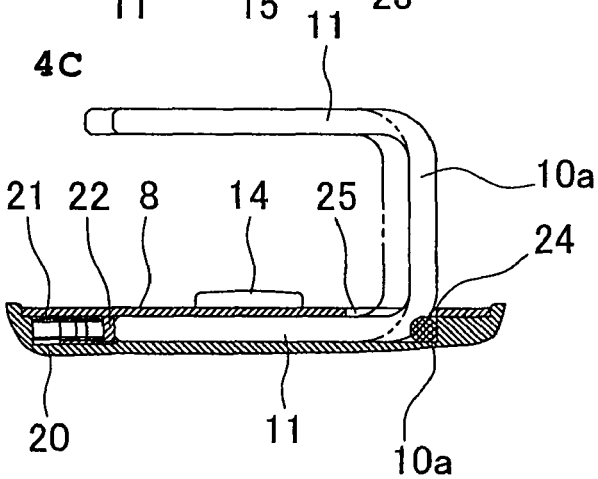

The first embodiment described above exemplifies a hook structure in which one and the same hook can be used at either of the left or right side of the power screwdriver 1, selectively. It is however appreciated that the same hook can also be used at the upper side of the power screwdriver 1 in some modified arrangements. According to a second embodiment of the present invention, one example of such a hook structure is shown as a hook unit 6*a* in FIG. 4A in which the same elements as in the first embodiment are designated by the same reference numerals, and a duplicate explanation will be omitted in describing the second embodiment.

This hook unit 6*a* has no upper hook fixed on the upper plate 8. In the housing 2, a depression 20 is provided at a front side of the recess 7. The depression 20 is recessed in alignment with an imaginary extension line extending frontward from the right groove 11 formed on the right side of the lock button 13 located in the upper-limit position so that the hook 10 is allowed to move to the front when the right hook leg 11 is fitted in the right groove 16. A lid 22 is provided in the depression 20, and is biased toward the back of the screwdriver 1 (to a position in which the opening of the depression 20 is closed with the lid 22) by a coil spring 21 ('second biasing mechanism') provided on the bottom of the depression 20.

On the other hand, in the upper plate 8, a slit 23 extending laterally from and perpendicularly to the left side of the upper plate 8 is formed in a position directly above a base portion 10*a* of the hook 10 which has been slid frontward from the left protruding position with its right hook leg 11 fitted in the depression 20. The slit 23 is an upward opening through which the hook 10 is swingable on its right hook leg 11 so as to allow the left hook leg 11 to move to an upward protruding position. The slit 23 has an end shaped like a letter T with a holding recess 24 extending backward and a clearance 25 extending forward, both of which are connected with the end of the slit 23 continuously. The holding recess 24 is configured to receive the base portion 10*a* of the hook 10 in the upward protruding position. The clearance 25 is configured to avoid interference with an inner side of a radiused corner portion of the hook 10. The holding recess 24 together with the coil spring 21 described above makes up a second retaining mechanism.

According to the hook structure configured as described above, similar to the first embodiment, the hook 10 can be set arbitrarily in one of the left protruding, right protruding and accommodating positions by the operations of depressing/releasing the lock button 13 and sliding the hook laterally. In addition, when the hook 10 is in the left protruding position, the hook 10 may be manipulated to slide forward while thrusting the lid 22 into the depression 20 by the right hook leg 11, and the left hook leg 11 can be turned upward so that the base portion 10*a* passes through the slit 23 to an upright position. When the hook 10 comes to the upright position and the forward thrusting force is released, the hook 10 slides backward by the action of the biasing force of the coil spring 21 and the base portion 10*a* is fitted into the holding recess 24 in which the hook 10 is retained in the upright position (upward protruding position). Consequently, the hook 10 can be used as an upper hook.

When the hook 10 is to be retracted from this upward protruding position, the hook 10 is temporarily slid forward to release the base portion 10*a* from the holding recess 24, and is turned to the left while keeping its forward position. The left hook leg 11 then turns together with the base portion 10*a* passing through the slit 23, and the hook 10 returns to the left protruding position. From this left protruding position, the hook 10 can be retracted back to the accommodating position.

As described above, in the hook unit 6*a* (as a hook structure according to the second embodiment), advantageously, the hook 10 can be rendered retractable when not in use and protrusible at both sides of the power screwdriver 1 when in use with a simple configuration, and thus the usability or convenience of the power screwdriver 1 can be improved, as in the first embodiment. Additionally, in the second embodiment, the hook 10 is configured to be swingable through the slit 23 as an 'upward opening' for the hook-receiving portion 9 so as to allow one of the hook legs 11 to move to the upward protruding position in which the one of the hook legs protrudes upward from the hook-receiving portion 9, and the second retaining mechanism configured to retain the hook in the upward protruding position is provided. Accordingly, the hook 10 can also be utilized as an upwardly protruding hook. That is, the variety of modes of using the hook 10 can be increased and the usability can be improved accordingly.

In particular, since the second retaining mechanism is made up of the coil spring 21 configured to bias the hook 10 in the upward protruding position backward, and the holding recess 24 provided continuously to the slit 23 to hold the hook 10 slid by the action of the biasing force of the coil spring 21, the hook 10 can be retained in the upward protruding position, easily in a simple and reasonable manner.

Third Embodiment

A description will now be given of a third embodiment which offers a selection of angles of upward protrusion of a hook. In a hook unit 6*b* shown in FIGS. 5A and 5B, a lock button 13 includes an operation part 14 and a locking element 15 provided on the right side of the operation part 14, and a groove 16 formed between the operation part 14 and the locking element 15 is disposed in a center of the hook-receiving portion 9. A depression 20, a coil spring 21 and a lid 22 are disposed in alignment with an imaginary extension line extending frontward from the groove 16 when the lock button 13 is located in the upper-limit position. Moreover, in the hook-receiving portion 9, a constraint block 26 is provided over a left area of a recess 7 to block up the left side of the operation part 14, with a space left at a left side of the constraint block 26, so as to allow the left hook leg 11 to be fitted on the constraint block 26 within the space. The constraint block 26 is also used as a seat to which an upper plate 8 is fastened by screws. In the third embodiment, the locking element 15 of the lock button 13, and the constraint block 26 constitute a retaining mechanism.

Figure 6A:
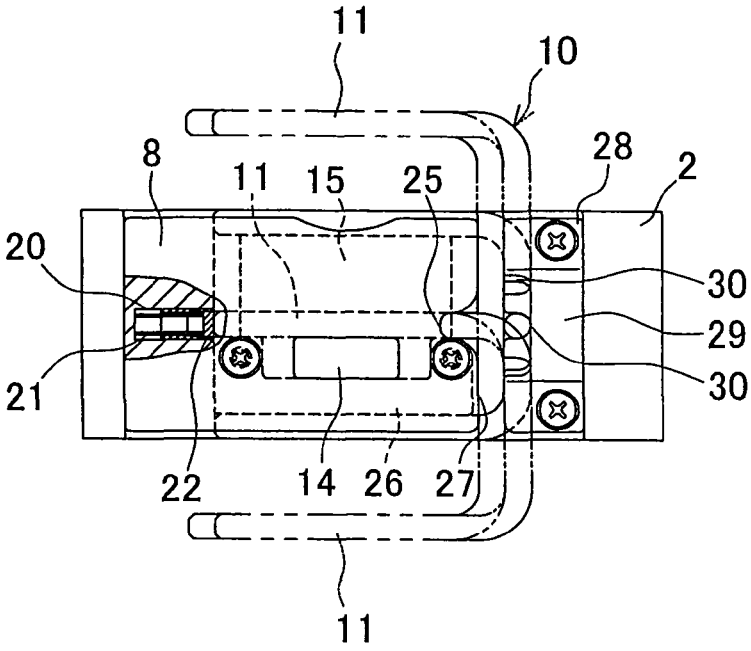
FIGS. 6A and 6B are explanatory diagrams showing a track of the hook moved according to the third embodiment.
Figure 6B:
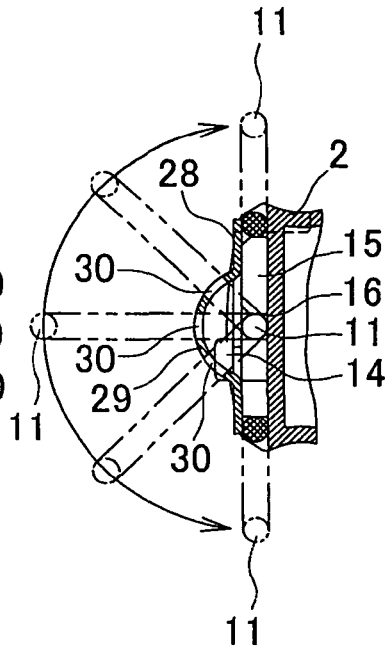

A holding plate 28 is provided in the housing 2, arranged parallel to the upper plate 8, and screwed onto the housing 2 in a position backward of the upper plate 8 with a slit 27 provided between the holding plate 28 and the upper plate 8. A vault-like bulging portion 29 is formed in a midsection of the holding plate 28. The slit 27 serves as an 'upward opening' through which the hook 10 is swingable upward. To be more specific, as shown in FIGS. 6A and 6B, the slit 27 is configured to allow the left hook leg 11 to swing within a 180-degree angle range on the right hook leg 11 that has been fitted in the groove 16 and slid to the front. Thus, when the hook 10 is fallen flat to the left or to the right and slid backward with the help of the biasing force of the coil spring 21, the base portion 10*a* moves across the slit 27 and goes under the holding plate 28, with the result that the operation of swinging, leftward or rightward of the hook 10 is restricted. At a front end of the bulging portion 29, three holding recesses 30 are provided, at its center, and left and right side positions tilted substantially at 45 degrees leftward and rightward, respectively. Each of these holding recesses 30 is configured to hold the base portion 10*a* of the hook 10 fitted therein.

Figure 5A:
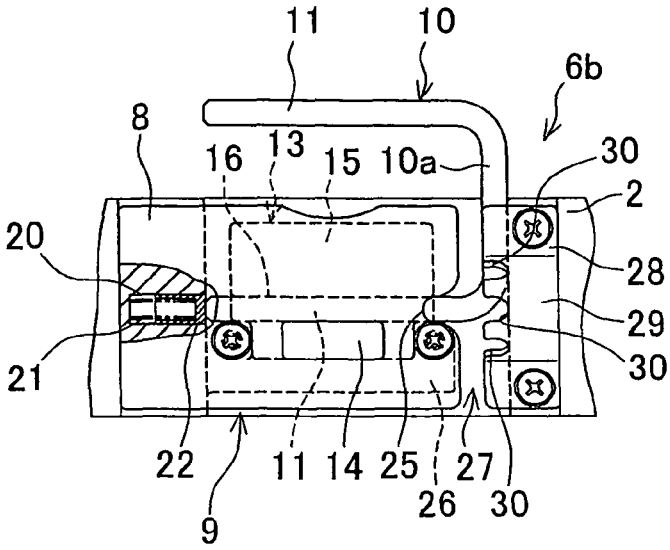
FIGS. 5A to 5E are explanatory diagrams of a hook structure of a power screwdriver according to a third embodiment, where
Figure 5B:
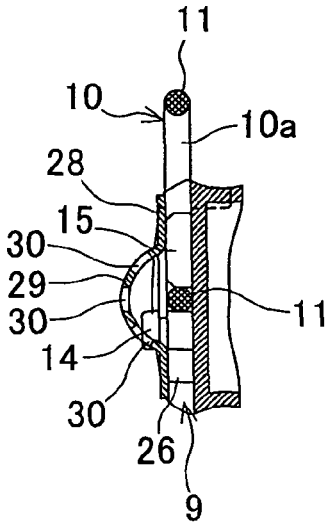

According to the hook structure configured as described above, when the hook with one of its left and right hook legs 11 fitted in the groove 16 is slid to the front and swung to the right, the base portion 10*a* of the hook 10 is moved through the slit 27 so that the hook 10 is turned flat on its right side. In this state, when the forward thrusting force for keeping the hook 10 forward along the groove 10 is released, the hook 10 is slid backward by the action of the biasing force of the coil spring 21, and the base portion 10*a* is held between the holding plate 28 and the recess 7 as shown in FIGS. 5A and 5B. In this way, the hook 10 becomes usable in the right protruding position.

Figure 5C:
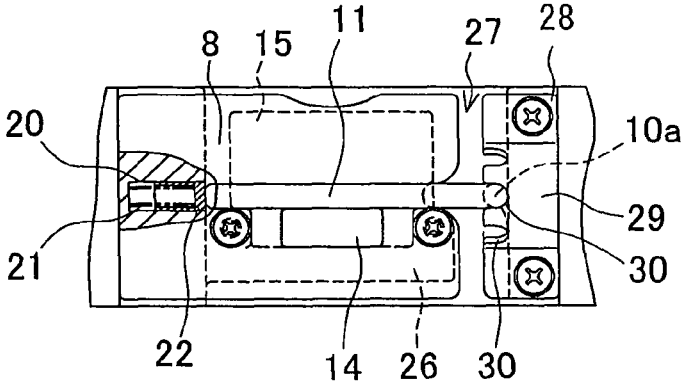
Figure 5D:
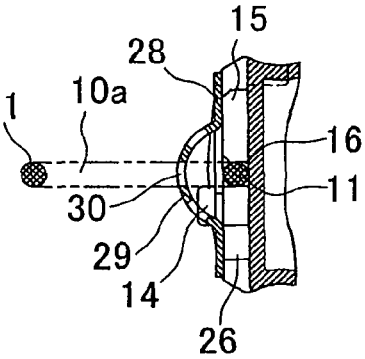
Figure 5E:
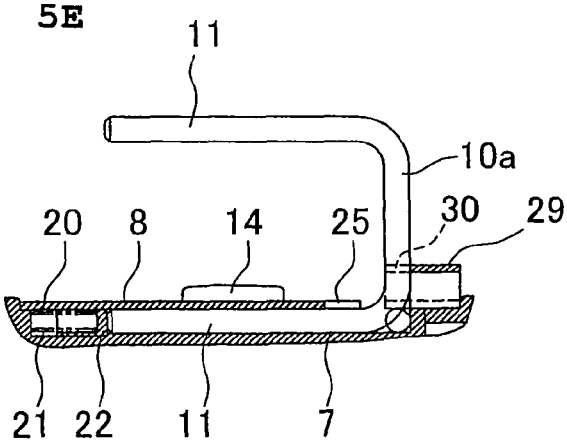

When the hook 10 is to be raised from this right protruding position, the course reverse to the above process sequence is followed; i.e., the hook 10 is temporarily slid forward until the base portion 10*a* comes to a position directly below the slit 27, and the hook 10 is swung up to the left while keeping the forward position. If the forward thrusting force is released when the hook 10 is positioned at an angle of 90 degrees, then the base portion 10*a* is fitted into and held in the holding recess 30 located at the center of the bulging portion 29, so that the hook 10 is retained in its central upward protruding position, as shown in FIGS. 5C and 5E. On the other hand, when the base portion 10*a* is fitted into and held in the holding recess 30 located at the left or right side position tilted at an angle of 45 degrees, the hook 10 is retained in its left or right obliquely upward protruding position, as shown in FIGS. 6A and 6B.

Figure 7A:
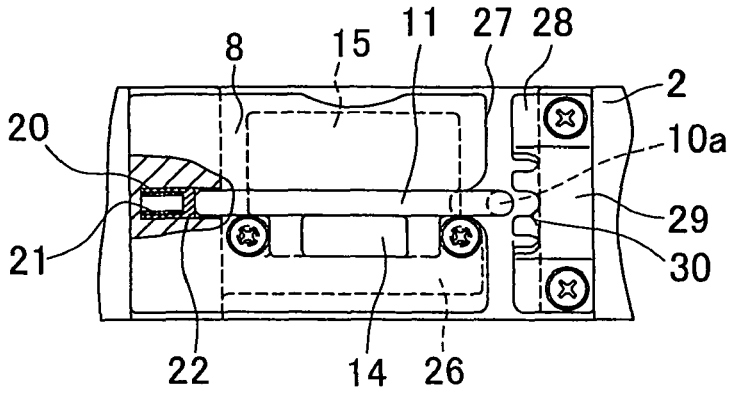
FIGS. 7A, 7B and 7C are explanatory diagrams showing a change in the state of the hook structure in which the hook moves from an upward protruding position to a left protruding position.
Figure 7B:
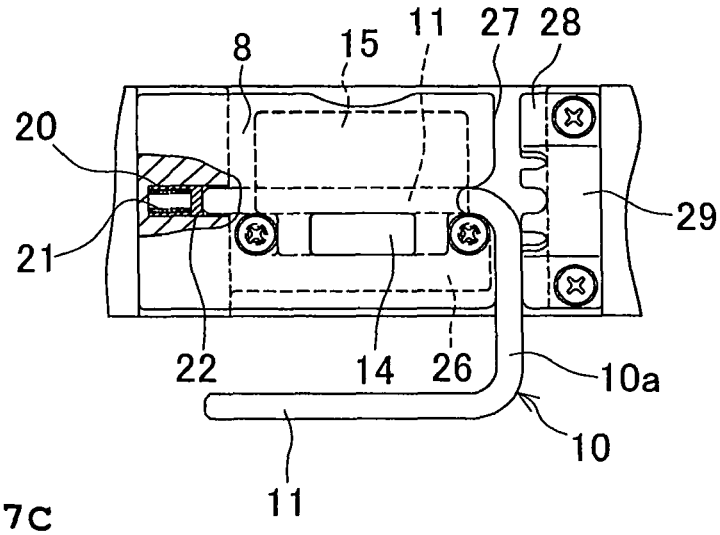
Figure 7C:
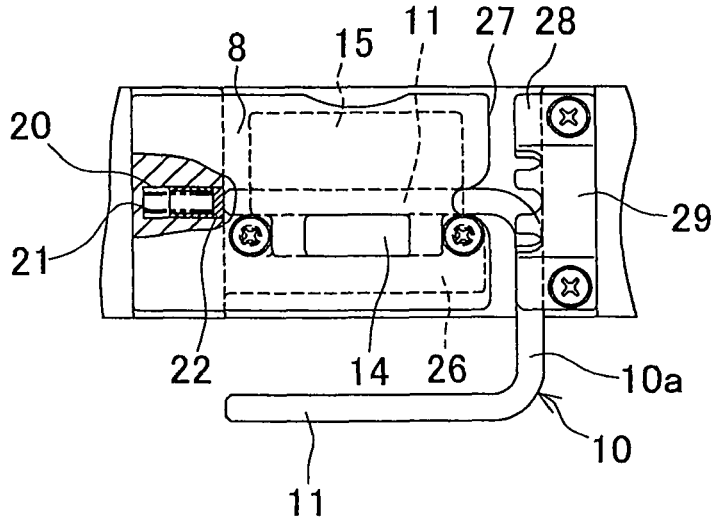

Next, starting from any of the upward protruding positions, the hook 10 is temporarily slid forward to release the constraint placed on its movement by the holding recess 30 as shown in FIG. 7A, and the base portion 10*a* is turned leftward. Thus, the hook 10 is fallen flat on its left side as shown in FIG. 7B. In this state, when the forward thrusting force for keeping the hook 10 forward along the groove 10 is released, the hook 10 is slid backward by the action of the biasing force of the coil spring 21, and the base portion 10*a* is held between the holding plate 28 and the recess 7, as shown in FIG. 7C. In this way, the hook 10 becomes usable in the left protruding position.

Figure 8A:
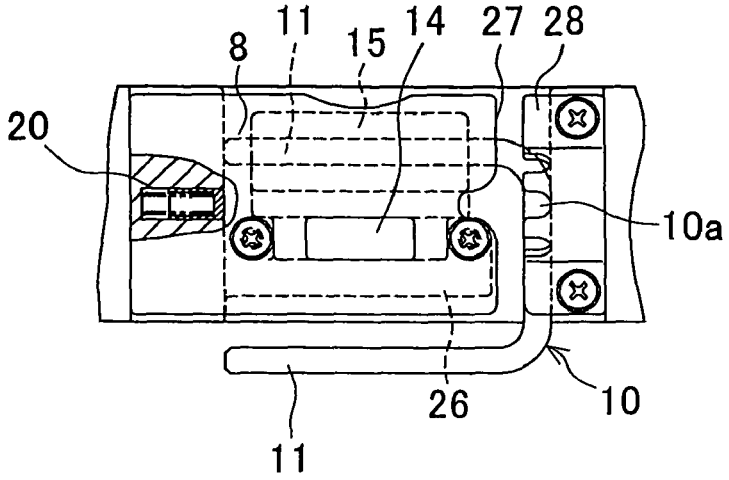
FIGS. 8A to 8D are explanatory diagrams showing a change in the state of the hook structure in which the hook moves from the left protruding position to an accommodating position.
Figure 8B:
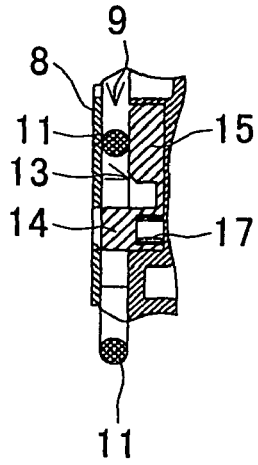
Figure 8C:
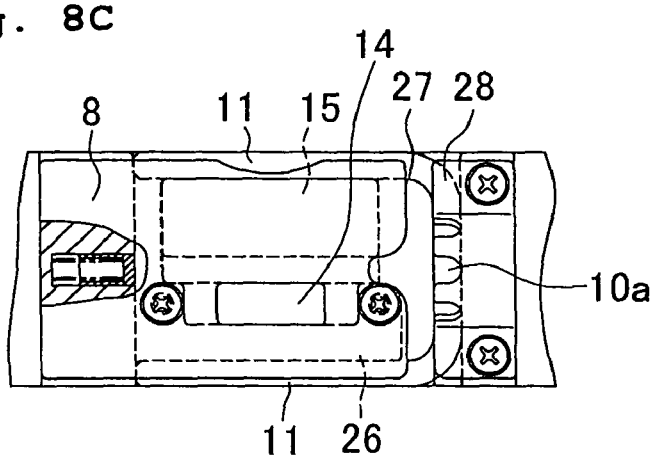
Figure 8D:
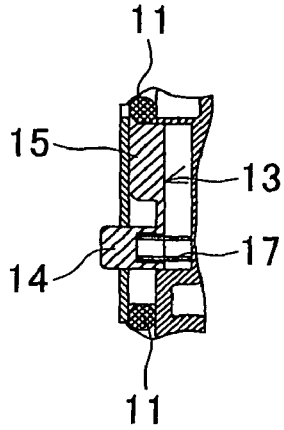

When the hook 10 is to be retracted from this left protruding position and accommodated, the lock button 13 is depressed into the lower-limit position to disengage the right hook leg 11 from the groove 16, and the hook 10 is slid as shown in FIGS. 8A and 8B toward the center. When the hook 10 has come to the central position, and the lock button 13 is released, the locking element 15 is fitted on the inner side of the right hook leg 11 and the constraint block 26 is fitted on the inner side of the left hook leg 11, so that the hook 10 is held in the accommodating position.

As described above, in the hook unit 6*b* (as a hook structure according to the third embodiment) as well, the hook 10 can be rendered retractable when not in use and protrusible at either right or left side and in the upward protruding positions when in use with a simple configuration, and thus the advantageous effects as exhibited in the first and second embodiments can be achieved. In particular, the third embodiment offers a selection of three angles of upward protrusion of a hook, and thus the variety of modes of using the hook 10 can be increased and the usability can be improved accordingly.

Fourth Embodiment

The first, second and third embodiments described above exemplify a hook structure in which a lock button movable between an upper engaging position inside the hook-receiving portion and a lower disengaging position outside the hook-receiving portion is provided as a 'retaining mechanism'. It is however appreciated that a hook structure of a type in which a sliding member is used may be adopted. According to a fourth embodiment of the present invention, one example of such a hook structure is shown as a hook unit 6*c* in FIGS. 9A, 9B and 10. In FIG. 10, the hook unit 6*c* is illustrated without its upper plate 8.

In the hook unit 6*c*, a guide member 31 having a substantially U-shaped cross section is provided integrally on a midsection of the base portion 10*a* of the hook 10. To be more specific, the guide member 31 is fitted from backward on the base portion 10*a* with the upper and lower inner surfaces of rectangular recess of the guide member 31. A guide piece 32 protruding downward is provided at an underside of the guide member 31. The guide piece 32 is slidably fitted in a guide groove 33 extending laterally in the bottom surface of the recess 7. Accordingly, a lateral sliding motion of the hook 10 is guided by the guide member 31 and the guide groove 33 so that the hook 10 is slidable to the left and to the right.

An engageable recess 34 which is a portion recessed slightly deeper than the recess 7 is formed in the forward/backward direction at a center of the bottom surface of the recess 7 in a position forward of the guide groove 33. Around this engageable recess 34 except its back side, a constraint wall 35 standing upright is provided. A slider control 36 as a 'sliding member' is accommodated in a space enclosed by the constraint wall 35, in a manner that permits the slider control 36 to move in the forward/backward direction. The slider control 36 is biased by a coil spring 37 as a 'biasing device' provided in a forward position within the constraint wall 35, toward a backward position ('engaging position') in which a engageable projection 38 provided at the rear end of the slider control 36 protrudes backward through the constraint wall 35. A notch 39 as an 'engageable portion' with which the engageable projection 38 of the slider control 36 located in the engaging position is engageable is formed in the midsection of the front sides of the base portion 10*a* of the hook 10 and the guide member 31. Denoted by 40 is an operation part which has an oblong shape elongated in the forward/backward direction as viewed from top and is provided on the upper surface of the slider control 36.

On the other hand, a downwardly recessed plate member 41 is provided in the center of the upper plate 8. A slot 42 which has an oblong shape elongated in the frontward/backward direction and has a length longer than that of the operation part 40 is formed at a center of the downwardly recessed plate member 41. The operation part 40 of the slider control 36 is slidably fitted in the slot 42 and exposed outwardly through the slot 42. When the slider control 36 is in the backward position, the operation part 40 is in the rear end of the slot 42. The slider control 36 is configured to be manipulatable manually with a finger or the like, so that the slider control 36 located initially in the backward position can be slid forward against the biasing force of the coil spring 37.

Figure 11C:
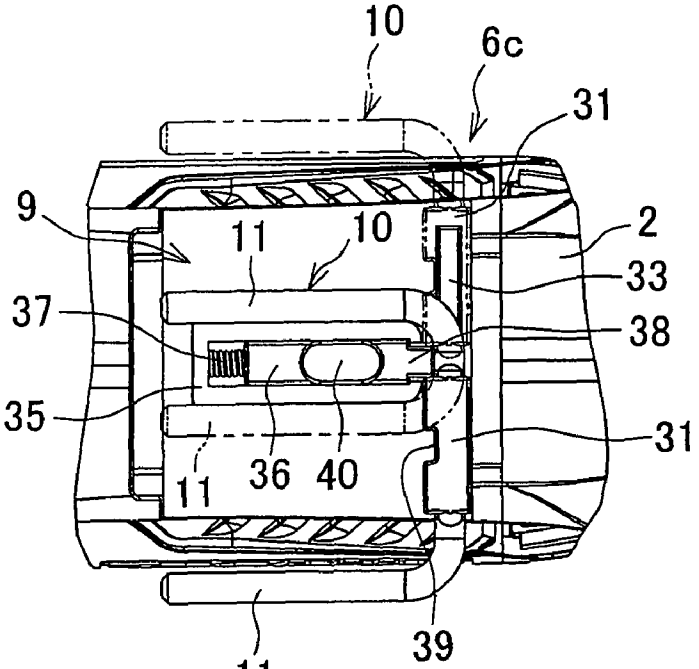
FIGS. 11A to 11D are explanatory diagrams showing a change in the state of the hook structure in which the hook moves from an accommodating position to a left protruding position, wherein a plan view shown in FIGS. 11A and 11C in each drawing figure is illustrated without upper plate.
Figure 11D:
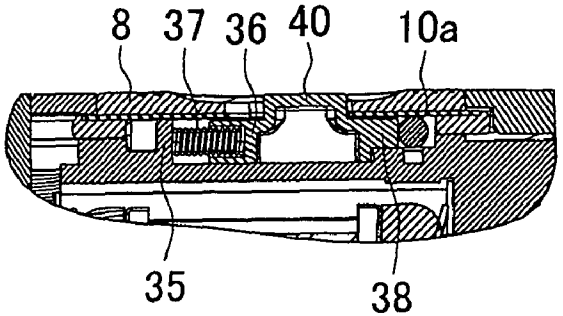
Figure 11A:
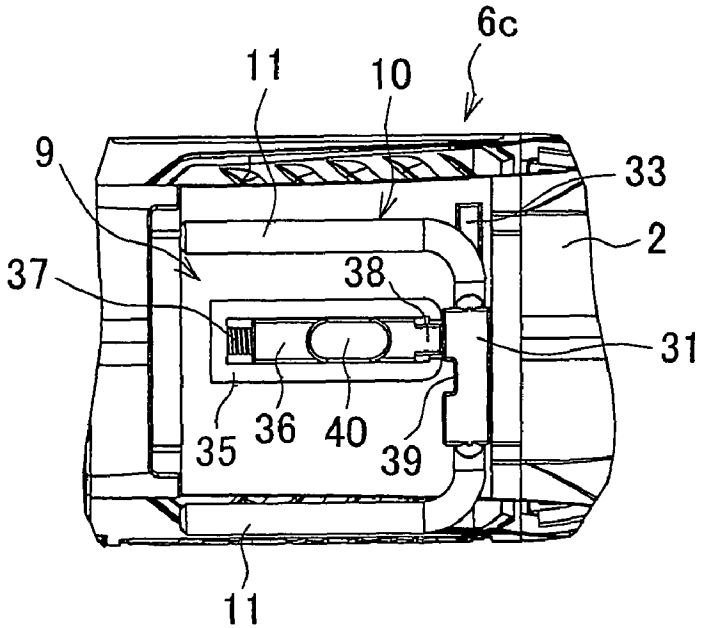
Figure 11B:
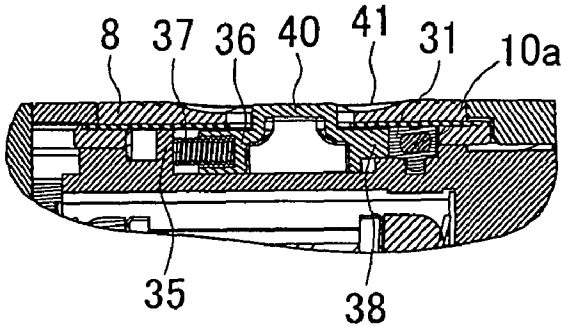

According to the hook structure configured as described above, when the slider control 36 is slid forward by means of the operation part 40, the engageable projection 38 disengages from the notch 39 formed in the base portion 10*a* of the hook 10 (hereupon, the slider control 36 is in a 'disengaging position' in that the hook 10 is released here). In this way, the hook 10 is allowed to slide laterally through the hook-receiving portion 9, as shown in FIGS. 11A and 11B. If the slider control 36 is released for example when the hook 10 is in a position in which the right hook leg 11 of the hook 10 abuts on the constraint wall 35, then the slider control 36 moves backward so that the engageable projection 38 abuts on the base portion 10*a* of the hook 10 and engages with a right side surface of the guide member 31 as another 'engageable portion', as shown in FIGS. 11C and 11D. Accordingly, the hook 10 is held by the slider control 36 which prevents the hook 10 from sliding laterally, so that the hook 10 is retained in the left protruding position in which the left hook leg 11 protrudes leftward from the hook-receiving portion 9. On the other hand, when the hook 10 is retained in the right protruding position in which the right hook leg 11 protrudes rightward from the hook-receiving portion 9, the engageable projection 38 abuts and engages with a left side surface of the guide member 31 as yet another 'engageable portion', as indicated by chain double-dashed lines in FIGS. 11C and 11D, to prevent the hook 10 from sliding laterally.

Figure 9A:
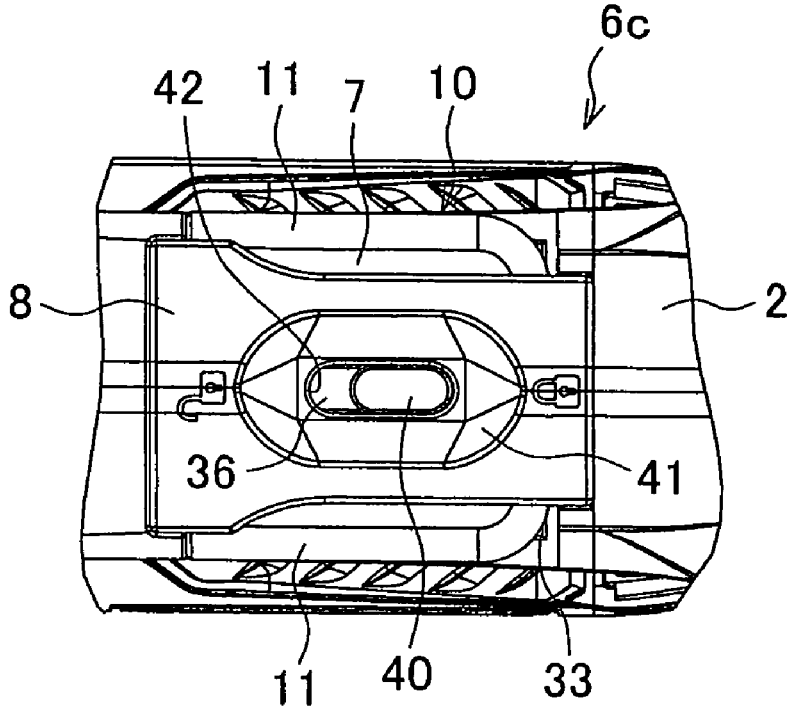
FIGS. 9A and 9B explicatively illustrate a hook structure according to a fourth embodiment, where a plan view thereof is shown in FIG. 9A, and a longitudinal sectional view thereof is shown in FIG. 9B.
Figure 9B:
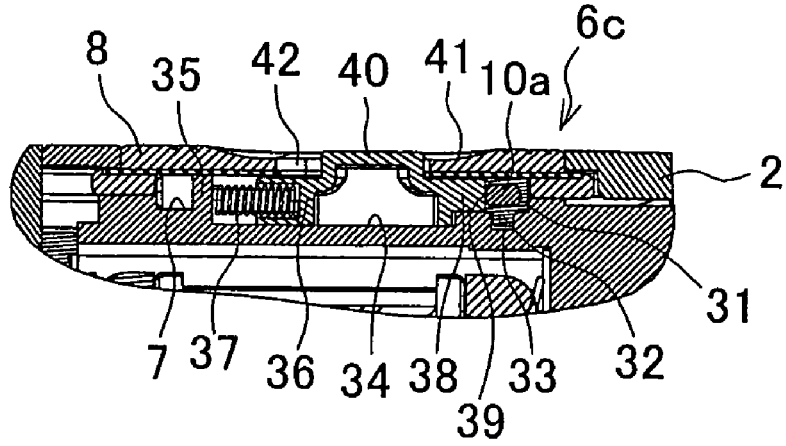
Figure 10:
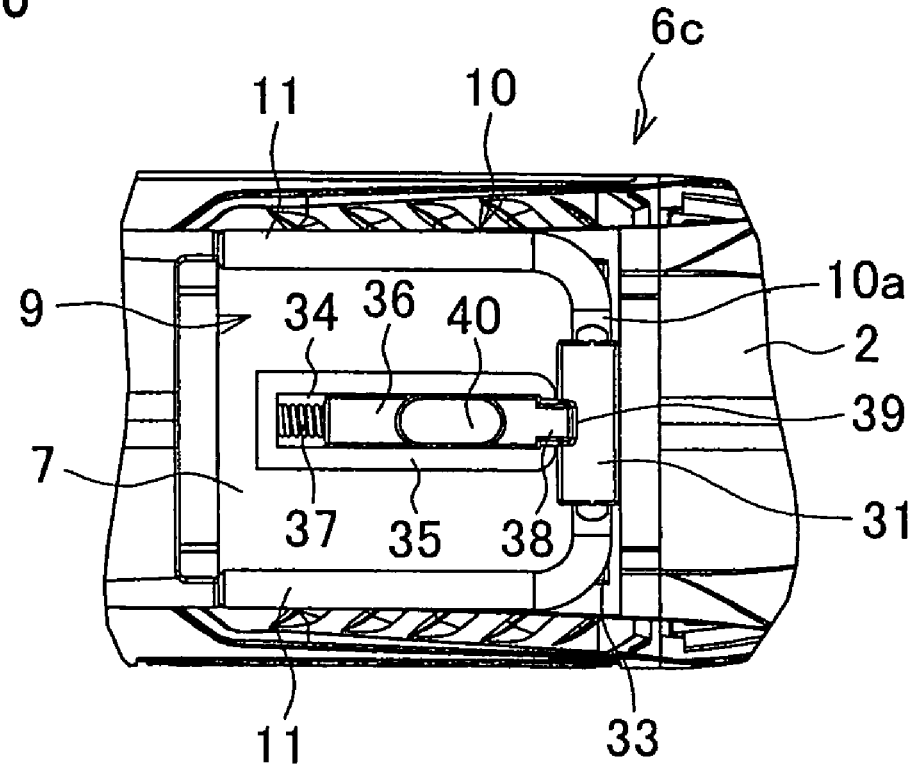
FIG. 10 is a plan view of the hook structure of FIG. 9A which is shown without upper plate.

When the hook 10 is to be retracted, the slider control 36 is slid forward and kept in the disengaging position while the hook 10 is being slid toward the center, and after the hook 10 reaches the accommodating position in the center, the finger of an operator is released from the operation part 40 so that the slider control 36 returns to the engaging position again, as shown in FIGS. 9A, 9B and 10, and the engageable projection 38 is fitted in the notch 39. Consequently, the hook 10 is fully retracted in the hook-receiving portion 9 and retained in the accommodating position in which neither of the left nor right hook leg 11 protrudes therefrom.

As described above, in the hook unit 6*c* (as a hook structure according to the fourth embodiment), advantageously, the hook 10 can be rendered retractable when not in use and protrusible at both sides of the power screwdriver 1 when in use with a simple configuration, and thus the usability or convenience of the power screwdriver 1 can be improved, as in the first embodiment.

In particular, the retaining mechanism in this embodiment comprises a sliding member (slider control 36), a biasing device (coil spring 37) and a plurality of engageable portions (notch 39 and left and right side surfaces of the guide member 31), wherein the sliding member is manipulatable from outside of the hook-receiving portion 9 to slide between the engaging position in which the hook 10 is retained and the disengaging position in which the hook 10 is released, the biasing device is configured to bias the sliding member toward the engaging position, and the plurality of engageable portions are provided on the hook. Accordingly, by manipulating the slider control 36 from outside, the hook 10 can be retained in any one of the positions of the left protruding position, right protruding position and accommodating position through a simple sliding operation. That is, an improved operability in alteration of the position of the hook 10 can be achieved. Furthermore, as contrasted with the embodiment in which the lock member of push-button type is pressed down, the amount of protrusion of the operation part 40 from the upper plate 8 can be reduced.

It is contemplated that numerous modifications may be made to each of the exemplary embodiments of the invention. For example, the hook consistent with the present invention is not limited to a bent round bar, but may be made out of a rectangular strip bent in a substantially U shape. Also, the lock button may have locking elements modified in position and/or in size as appropriate according to the shape of the hook adopted. The shape of the part making up the locking elements is not limited to a rectangular parallelepiped block, but may be changed into any shape that can retain the hook in the left and right protruding positions; for example, an upright rectangular parallelepiped wall-like projection, or a plurality of ribs may be formed, instead. The operation part located at the center may be replaced by a projection provided on top of the locking elements and configured to manipulatable from outside.

Moreover, the biasing device configured to bias the lock button or the slider control may be embodied not only by a coil spring but also by a leaf spring or other elastic member.

Furthermore, although a hook unit in each of the above embodiments is provided at an upper surface of the housing, the hook unit may be provided in any other positions, for example, at an end of the grip of the power screwdriver. The power tool to which the hook structure consistent with the present invention is applicable is not limited to the power screwdriver as illustrated in the above embodiments, but may be any power tool having a hook structure, such as a drill, a fastening driver, a circular saw, or the like.

To illustrate other modifications specific to each embodiment, the hook structure according to the first embodiment may have no upper hook, and the hook structure according to the second embodiment may have locking elements arranged in positions reversed left to right and/or may have another type of the second biasing device without a lid wherein an elastic member such as a coil spring or a leaf spring is configured to directly bias the hook. Alternatively, it may be conceivable that the second biasing device is provided at the back of the hook and configured to bias the hook forward and a holding recess for holding the hook in the upward protruding position is provided in the upper plate. The holding recess in the second embodiment may be substituted with a projection having a plurality of holding recesses as in the third embodiment so that the hook may have a variable angle in the upward position.

Similarly, in the third embodiment, the arrangement of the lock button and the constraint block may be reversed left to right, the second biasing device may be modified where appropriate, and/or the number of holding recess(es) may be increased or reduced.

In the fourth embodiment, the guide member mounted to the hook may be omitted, and a depression or notch into which the slider control can be fitted may be provided directly in the base portion of the hook, or projections corresponding to the left protruding, right protruding and accommodating positions respectively may be provided at the hook while a depression into which the projections can be fitted is provided in the slider control so that the one of the projections may engage with the depression to retain the hook in a desired position. Alternatively or additionally, any of the constraint wall, the guide piece and the guide groove may be omitted, and any other modifications or changes in design may be made within the scope of the present invention.

What is claimed is:

1. A hook structure of a power tool having a housing including an upper housing, a lower housing, and a grip disposed in the lower housing, the hook structure comprising:

a hook-receiving portion formed in the upper housing and disposed above the grip of the power tool, with openings facing leftward and rightward;

a substantially U-shaped hook having two legs, wherein the hook-receiving portion of the housing is capable of accommodating the hook, and the hook is movable among a left protruding position in which a left hook leg of the two legs protrudes leftward from the hook-receiving portion, a right protruding position in which a right hook leg of the two legs protrudes rightward from the hook-receiving portion, and an accommodating position in which the left and right hook legs are both accommodated in the hook-receiving portion and are fully retracted without protruding on either side of the hook-receiving portion; and a retaining mechanism by which the hook is retainable in one of the positions of the left protruding position, the right protruding position, or the accommodating position.

2. The hook structure according to claim 1, wherein the retaining mechanism comprises:

a lock member comprising:

an engageable part that is engageable with the hook in one of the left protruding, the right protruding, or the accommodating positions, the lock member being movable between an upper engaging position in which the engageable part protrudes into the hook-receiving portion so as to engage with the hook, a lower disengaging position in which the engageable part retracts out of the hook-receiving portion so as to disengage from the hook; and a biasing device configured to bias the lock member toward the upper engaging position, wherein the lock member is configured to be manipulatable from outside the hook-receiving portion so as to be pressed down into the lower disengaging position.

3. The hook structure according to claim 1, wherein the hook-receiving portion is formed between a recess formed in the housing and an upper plate mounted in a position spaced at a predetermined distance out from the recess.

4. The hook structure according to claim 2, wherein the lock member is configured as a lock button which comprises an operation part protruding upward through a center of an upper plate, the engageable part of the lock button comprises left and right locking elements, the left and right locking elements protruding toward inward of the hook-receiving portion, upward to a level lower than that of the operation part, the left and right locking elements being disposed apart from the operation part leftward and rightward respectively, with clearances given between the operation part and each respective locking element such that one of the left and right hook legs fits in one of the clearances.

5. The hook structure according to claim 4, wherein the engageable part of the lock button has a dimension such that the engageable part fits in a clearance between the left and right hook legs of the hook.

6. The hook structure according to claim 2, wherein the biasing device comprises a coil spring.

7. The hook structure according to claim 1, further comprising a second retaining mechanism, wherein the hook-receiving portion is provided with an upward opening facing upward, through which the hook is swingable so as to allow one of the left or right hook legs to move to an upward protruding position in which the one of the left or right hook legs protrudes upward from the hook-receiving portion, and the second retaining mechanism is configured to retain the hook in the upward protruding position.

8. The hook structure according to claim 2, further comprising a second retaining mechanism, wherein the hook-receiving portion is provided with an upward opening facing upward, through which the hook is swingable so as to allow one of the left or right hook legs to move to an upward protruding position in which one of the left or right hook legs protrudes upward from the hook-receiving portion, and the second retaining mechanism is configured to retain the hook in the upward protruding position.

9. The hook structure according to claim 8, wherein the second retaining mechanism comprises a second biasing device and a holding recess, the second biasing device being configured to bias the hook toward a forward or a backward direction, and the holding recess is provided continuously with the upward opening to allow the hook in the upward protruding position to move in the forward or the backward direction by the action of the biasing device so that the hook moved in the holding recess is held in the upward protruding position.

10. The hook structure according to claim 9, wherein a depression configured to receive one of the left or the right hook legs of the hook to allow the hook to move in the forward direction is provided in the housing, and the second biasing device comprises a coil spring provided in the depression and configured to bias one of the left or right hook legs so that the hook in the upward protruding position is moved in the backward direction.

11. The hook structure according to claim 9, wherein the upward opening is shaped like a slit extending laterally from a side edge of an upper plate and having an end connected to the holding recess.

12. The hook structure according to claim 10, wherein the upward opening is shaped like a slit extending laterally between an upper plate and a holding plate fixed at a back side of the upper plate, and a vault-like bulging portion is formed in a center of the holding plate, with a plurality of holding recesses provided at a front end of the bulging portion so that a base portion of the hook in the upward protruding position is allowed to move in the backward direction and held in one of the holding recesses.

13. The hook structure according to claim 1, wherein the retaining mechanism comprises:

a sliding member that is slidable between an engaging position in which the hook is retained in one of the positions of the left protruding position, the right protruding position, or the accommodating position, and a disengaging position in which the hook is released;

a biasing device configured to bias the sliding member toward the engaging position; and a plurality of engageable portions provided on the hook and configured such that the sliding member in the engaging position is engageable with one of the plurality of engageable portions to thereby hold the hook in the corresponding one of the left protruding, the right protruding, or the accommodating positions, wherein the sliding member is configured to be manipulatable from outside the hook-receiving portion so as to be slid into the disengaging position.

14. The hook structure according to claim 13, wherein the sliding member is configured as a slider control which is supported slidably in a forward or a backward direction by a constraint wall provided at a center of a bottom surface of a recess, and the biasing device comprises a coil spring provided in a forward position within the constraint wall.

15. The hook structure according to claim 13, wherein at least one of the plurality of engageable portions is configured as a notch provided at a base portion of the hook.

16. The hook structure according to claim 14, wherein a slot elongated in a forward/backward direction is formed at a center of an upper plate, and an operation part protruding outwardly through the slot is provided on an upper surface of the slider control.

17. The hook structure according to claim 13, wherein a guide piece protruding downward is provided at a lower side of a base portion of the hook, and a guide groove disposed to extend laterally and configured to receive the guide piece is formed to guide a lateral sliding motion of the hook.

* * * * *